US012480194B2

(12) United States Patent
Maschler et al.

(10) Patent No.: US 12,480,194 B2
(45) Date of Patent: Nov. 25, 2025

(54) METHOD FOR THE PREOXIDATION OF STRIP STEEL IN A REACTION CHAMBER ARRANGED IN A FURNACE CHAMBER

(71) Applicant: SMS GROUP GMBH, Duesseldorf (DE)

(72) Inventors: Frank Maschler, Duisburg (DE); Lutz Kuemmel, Juechen (DE); Jean-Pierre Crutzen, Chaudfontaine (BE)

(73) Assignee: SMS GROUP GMBH, Duesseldorf (DE)

( * ) Notice: Subject to any disclaimer, the term of this patent is extended or adjusted under 35 U.S.C. 154(b) by 913 days.

(21) Appl. No.: 16/764,234

(22) PCT Filed: Nov. 6, 2018

(86) PCT No.: PCT/EP2018/808242
§ 371 (c)(1),
(2) Date: May 14, 2020

(87) PCT Pub. No.: WO2019/096616
PCT Pub. Date: May 23, 2019

(65) Prior Publication Data

US 2023/0193442 A1 Jun. 22, 2023

(30) Foreign Application Priority Data

Nov. 17, 2017 (DE) ..... 102017220583.0
Mar. 28, 2018 (DE) ..... 102018107435.2

(51) Int. Cl.

| | |
|---|---|
| ***C23C 2/02*** | (2006.01) |
| ***C21D 1/74*** | (2006.01) |
| ***C21D 1/76*** | (2006.01) |
| ***C21D 9/56*** | (2006.01) |
| ***C23C 8/10*** | (2006.01) |
| ***C23C 8/80*** | (2006.01) |

(52) U.S. Cl.
CPC ..... *C23C 2/02* (2013.01); *C21D 1/74* (2013.01); *C21D 1/76* (2013.01); *C21D 9/561* (2013.01); *C23C 2/0222* (2022.08); *C23C 2/026* (2022.08); *C23C 8/10* (2013.01); *C23C 8/80* (2013.01)

(58) Field of Classification Search
CPC ..... C23C 2/02; C23C 2/0222; C23C 2/026; C23C 8/10; C23C 8/80; C21D 1/76; C21D 9/561; C21D 1/74
See application file for complete search history.

(56) References Cited

U.S. PATENT DOCUMENTS

| | | | | |
|---|---|---|---|---|
| 3,342,649 | A * | 9/1967 | Morgan | C21D 1/84 148/633 |
| 2006/0243357 | A1* | 11/2006 | Lecomte | C21D 9/573 148/625 |
| 2010/0304146 | A1* | 12/2010 | Krebs | C23C 16/4415 134/1.1 |
| 2011/0305912 | A1* | 12/2011 | Teer | C23C 14/35 428/688 |
| 2018/0142339 | A1* | 5/2018 | Dubois | C21D 9/561 |
| 2020/0305242 | A1* | 9/2020 | Wiswall | C21D 1/42 |

FOREIGN PATENT DOCUMENTS

| | | | |
|---|---|---|---|
| DE | 102011051731 | A1 | 1/2013 |
| EP | 2458022 | A1 | 5/2012 |
| EP | 3170913 | A1 | 10/2016 |
| WO | 2012152508 | A1 | 11/2012 |
| WO | 2016169918 | A1 | 10/2016 |
| WO | 2016177590 | A1 | 11/2016 |

OTHER PUBLICATIONS

International Search Report of the International Searching Authority, dated Jan. 18, 2019 for corresponding PCT patent application No. PCT/EP2018/080242.

* cited by examiner

*Primary Examiner* — Adil A. Siddiqui
(74) *Attorney, Agent, or Firm* — Amster, Rothstein & Ebenstein LLP

(57) ABSTRACT

Method for the preoxidation of high-strength strip steel. The invention relates to an improved method for the preoxidation of high-strength strip steel in a reaction chamber arranged in a furnace chamber. The reaction chamber is sealed at a strip entrance and a strip exit against gas exchange between the furnace chamber and the reaction chamber, and a gas that forms an oxidizing atmosphere in the reaction chamber is introduced, and the gas is continuously circulated within the reaction chamber.

1 Claim, No Drawings

METHOD FOR THE PREOXIDATION OF STRIP STEEL IN A REACTION CHAMBER ARRANGED IN A FURNACE CHAMBER

CROSS REFERENCE TO RELATED APPLICATIONS

This application is a national phase of PCT application No. PCT/EP2018/080242, filed Nov. 6, 2018, which claims priority to DE patent application No. 102017220583.0, filed Nov. 17, 2017, and DE patent application No. 102018107435.2, filed Mar. 28, 2018 all of which are incorporated herein by reference thereto.

The invention relates to an improved method for the preoxidation of oxidation-sensitive steel strip in a reaction chamber arranged in a furnace chamber, in order to thereby set surface properties of the steel strip to be coated suitable for hot-dip coating directly following the preoxidation.

Conventional high-strength steel strips contain manganese, silicon and/or aluminum as alloying elements. During the optional recrystallizing annealing prior to the hot-dip coating, these alloying elements diffuse towards the strip surface. Due to their very high affinity for oxygen, these alloying elements are almost inevitably oxidized if they are located on the surface of the strip or at a shallow depth in the strip. However, the base material iron is not oxidized. This phenomenon is also known as selective oxidation. However, the manganese, silicon and/or aluminum oxides formed on the surface by the selective oxidation impair the wettability of the strip surface with a molten coating metal (for example zinc), with the result of imperfections (so-called bare spots) or poor adhesion of the coating with the strip surface. The alloy composition is decisive for the coating problems on high-strength steel, especially the tendency to form irreducible oxides on the surface.

This applies for example to the following steel grades:

| Group | C max [%] | Si max [%] | Mn max [%] | Cr + Mo max [%] |
|---|---|---|---|---|
| DP | 0.14-0.23 | 0.5-1.0 | 1.8-2.9 | 1.0-1.4 |
| CP | 0.18-0.23 | 1.0 | 2.5-2.9 | 1.0 |
| TRIP | 0.23-0.25 | 1.8-2.2 | 2.1-2.5 | 0.2 |
| Q&P | 0.10-0.30 | 1.0-2.0 | 1.5-3.0 | |

In order to improve adhesion of the coating to the surface of the strip, DE 102 004 059 566 describes a method in which the strip is preoxidized. The method described in this reference can be summarized as follows:

1 Heating the strip up to 650 to 750° C. under a reducing atmosphere, with 2 to 3% hydrogen;

2. Oxidizing the strip surface consisting largely of pure iron in a reaction chamber with an atmosphere containing 0.01 to 1% oxygen. Hereby, an iron oxide layer is formed which covers the previously formed alloy oxides. The treatment time is 1 to 10 seconds and the thickness of the oxide layer formed is 300 nm;

3. Annealing of the steel strip up to a maximum of 900° C. in a reducing atmosphere with 2 to 8% hydrogen content. The iron oxide layer is reduced to pure iron again, on which the coating metal then adheres well and securely.

The reaction chamber, with a strongly oxidizing inner atmosphere, is situated in the furnace chamber of a continuous furnace with a reducing atmosphere containing hydrogen. The sites at which the strip enters and exits the reaction chamber must be sealed as effectively as possible against gas exchange. A gas transfer from the furnace into the reaction chamber has the effect that the entering hydrogen at least partially consumes the oxygen required for the oxidation and adversely affects the nature of the desired oxide layer on the strip surface. This problem is exacerbated the lower the oxygen content in the reaction chamber. Conversely, a gas transfer from the reaction chamber into the furnace causes a higher water content (dew point) in the furnace and thus an increased oxidation potential. This is particularly disadvantageous for ultra high-strength steels with a higher proportion of alloying elements with an affinity for oxygen.

Tests have shown that the strip temperature is the decisive process parameter for setting a desired oxide layer. This temperature is preferably between 650 and 750° C. As long as the oxygen content is >1% and the treatment time is >1 s, their influence on the thickness of the formed oxide layer is negligible. A robust process can be ensured with oxygen contents in the range of 2 to 5%.

It is therefore an object of the present invention to provide an improved method for the preoxidation of high-strength steel strip in a reaction chamber within a furnace chamber during the recrystallizing annealing prior to a hot-dip coating.

According to the teaching of the invention, this object is achieved by the features set forth in claim 1, in particular in that the reaction chamber is sealed at a strip entrance and a strip exit against gas exchange between the furnace space and the reaction chamber and a gas, which forms an oxidizing atmosphere in the reaction chamber, is introduced and is continuously circulated inside the reaction chamber in a closed circuit, with the composition of the gas being regulated and losses due to leakage and consumption are compensated.

In this way, it is possible to produce a particularly uniform oxide layer on the strip surface, so that defects in the subsequent hot-dip coating are avoided and the quality of the end product is improved and scrap is reduced.

The reaction chamber is sealed off from the furnace space and in particular at the strip entrance and strip exit against gas exchange.

The atmosphere is constantly circulated. For this purpose, the gas is evacuated from the reaction chamber, cooled, fed to a fan, enriched with fresh air and fed back into the chamber. This ensures good homogeneity of the atmosphere.

A further desired effect is that gas with high kinetic energy density is supplied to the strip surface in a controlled and uniform manner via nozzle systems (at least one nozzle system) with the aid of nitrogen as carrier gas. This is necessary to avoid laminar boundary layer effects.

In order to achieve a sufficient buffer against the ingress of hydrogen, the oxygen content of the atmosphere in the reaction chamber is at least 1.5 vol % to a at most 5 vol %.

The reaction chamber has a vent to compensate for changes in volume. This vent is preferably regulated in such a way that the internal pressure of the reaction chamber corresponds to the pressure of the surrounding furnace atmosphere and the gas exchange via the inevitable leaks is minimal.

These measures result in a well controllable oxidation process and prevent impairment of the furnace atmosphere surrounding the reaction chamber.

The oxidation-sensitive steel can contain at least one member selected from the following alloy components: Mn>0.5%, Al>0.7%, Si>0.1%, Cr>0.3%.

The invention claimed is:

1. A method for pre-oxidation of oxidation-sensitive steel strip in a reaction chamber arranged in a furnace chamber having a temperature between 650° and 750° C., an oxygen content >1%, and a treatment time greater than 1 s, the reaction chamber being sealed at a strip entrance and at a strip exit against gas exchange between the furnace chamber and the reaction chamber, the method comprising:

introducing a gas which forms an oxidizing atmosphere in the reaction chamber, the gas including nitrogen as a carrier gas in the oxidizing atmosphere, the gas being supplied to a surface of the oxidation-sensitive steel strip with high kinetic energy density in a controlled and uniform manner via at least one nozzle system which is associated with the reaction chamber, such that the application of the gas with the nitrogen from the at least one nozzle system avoids laminar boundary layer effects at the surface of the oxidation-sensitive steel strip;

continuously circulating the introduced gas inside the reaction chamber in a closed circuit, said continuous circulating of the introduced gas in the closed circuit including evacuating the oxidation gas from the reaction chamber, cooling the evacuated oxidation gas, feeding the cooled oxidation gas to a fan to enrich the cooled oxidation gas with air, and feeding the enriched, cooled oxidation gas back into the reaction chamber via the at least one nozzle system so that the oxidizing atmosphere is homogenized in the reaction chamber;

regulating a composition of the oxidation gas in the reaction chamber, said regulating including:

maintaining the oxygen content of the homogenized atmosphere in the reaction chamber at a minimum of 1.5 vol % to a maximum of 5 vol % to achieve a sufficient buffer against hydrogen ingress from the furnace chamber into the reaction chamber; and compensating, via a vent in fluid communication with the reaction chamber, for volume changes due to leakages and consumption occurring in the reaction chamber, said compensating including regulating the vent so that an internal pressure of the reaction chamber corresponds with an ambient atmospheric pressure of the furnace chamber, such that gas exchange as between the reaction chamber and the furnace chamber is minimized; and wherein the oxidation-sensitive steel strip contains at least one alloying component including: Mn>0.5%, Al>0.2%, Si>0.1%, Cr>0.3%, and wherein said homogenized atmosphere and said at least one nozzle system produce a uniform oxide layer on said oxidation-sensitive steel strip.

* * * * *